US005741763A

United States Patent [19]

Matsushita

[11] Patent Number: 5,741,763

[45] Date of Patent: Apr. 21, 1998

[54] LUBRICANT OIL COMPOSITION

[75] Inventor: Shouzou Matsushita, Saitama-ken, Japan

[73] Assignee: Exxon Research and Engineering Company, Florham Park, N.J.

[21] Appl. No.: 577,021

[22] Filed: Dec. 22, 1995

[51] Int. Cl.[6] ..... C10M 141/08

[52] U.S. Cl. ..... 508/413

[58] Field of Search ..... 508/413

[56] References Cited

U.S. PATENT DOCUMENTS

| | | | |
|---|---|---|---|
| 2,052,164 | 8/1936 | Buc | 508/413 |
| 3,857,789 | 12/1974 | Krupin et al. | 508/413 |
| 4,396,515 | 8/1983 | Sturwold | 508/413 |

FOREIGN PATENT DOCUMENTS

| | | | |
|---|---|---|---|
| 2854975 | 7/1980 | Germany | C10G 33/04 |
| 1198110 | 6/1986 | U.S.S.R. . | |
| 1103533 | 2/1968 | United Kingdom | C10M 1/40 |
| 2039901 | 8/1980 | United Kingdom | C07C 143/00 |

*Primary Examiner*—Jacqueline V. Howard
*Attorney, Agent, or Firm*—Joseph J. Allocca

[57] ABSTRACT

A lubricant oil composition comprising a minor portion of calcium sulfonate(s), barium sulfonate(s), or mixture thereof being neutral or having the total base number of 100 mg KOH/g or less, and straight chain univalent fatty acid(s) having 8 to 18 carbon atoms and a major portion of a base oil of mineral oil series and/or synthetic oil series, said base oil having a kinematic viscosity of 10 to 50 $mm_2/s$ at 40° C. The lubricant oil composition of the present invention exerts excellent separation properties from a cutting fluid prepared by diluting a water-soluble cutting fluid. Therefore, the composition so readily separates and floats in a reservoir tank for the cutting fluid that the composition can be removed simply by means of an oil skimmer and the like. Thus, the properties of the water-soluble cutting fluid can be maintained for a long term, with no occurrence of poor work environment due to rot and so on.

8 Claims, No Drawings

LUBRICANT OIL COMPOSITION

FIELD OF THE INVENTION

The present invention relates to a lubricant oil composition. More specifically, the present invention relates to a lubricant oil which can be separated immediately after it is mixed into a water-soluble cutting fluid, to readily remove the resultant floating oil components in separation by means of oil skimmers and the like.

PRIOR ART

For cutting and grinding metals, use is made of a cutting fluid to lubricate surfaces of tools and materials to be cut as well as to improve the finishing precision of the processed surfaces and to decrease the wear of the tools so as to elongate the tool life. Cutting oils are grouped into water-insoluble cutting fluids produced by adding oils, extreme pressure agents or the like to mineral oils, and water-soluble cutting fluids comprising a base oil, a surfactant, an extreme pressure agent and an oily agent, which are used after dilution with water. Generally, water-soluble cutting fluids have greater cooling effects that the fluids are widely used.

In cutting or grinding metal workpieces, use is made of a lubricant oil called sliding face oil on the sliding surface between a slider supporting a grinding plate such as a blade and a pedestal guiding surface, the sliding face oil being capable of moving the grinding plate in a smooth fashion even if friction is generated between the grinding plate and the workpiece to prevent stickslip phenomena.

Generally, stickslip preventive agents such as phosphate ester, fatty acids and fatty acid esters, are added to base oils so as to provide stickslip preventive properties. In addition to such stickslip preventive agents, furthermore, an antioxidant, a metal deactivator, an extreme pressure agent and a tackifier may be added to the sliding face.

When a water-soluble cutting fluid is used on cut or ground portions of a workpiece, the water-soluble cutting fluid after use is transferred into a reservoir tank together with a part of a leaked sliding face oil. Also, in cutting or grinding metals, lubricant oils such as hydraulic-actuated oils and other tooling oils may frequently contaminate such water-soluble cutting fluids. In the reservoir tank, the water-soluble cutting fluids are separated from such lubricant oils to be recycled for use. Because water-soluble cutting fluids contain a large quantity of a surfactant, however, the lubricant oil contaminating the water-soluble cutting fluids forms emulsion, which often causes difficulty in separating the lubricant oil. The lubricant oil contaminating the water-soluble cutting fluid markedly deteriorates the properties of the water-soluble cutting fluid thereby shortening the life and causing poor work environment due to an offensive odor through rot and so on. Therefore, the development of a lubricant oil which can be separated immediately after its contamination into a water-soluble cutting fluid has been expected.

The object of the present invention is to provide a lubricant oil, which can separate and float immediately after its contamination into a water-soluble cutting fluid without forming stable emulsion and which can be removed readily from the water-soluble cutting fluid by means of an oil skimmer and the like.

PRESENT INVENTION

The present invention is a lubricant oil comprising a minor portion of a calcium sulfonate, barium sulfonate, or mixture therein being neutral or having a lower base number, and a straight chain univalent fatty acid having a specific number of the carbon atoms and a major portion of a base oil. The lubricating oil composition has excellent properties of separating from water soluble cutting fluids.

In other words, the present invention is to provide:

(1) a lubricant oil composition produced by blending a calcium sulfonate or barium sulfonate or mixture thereof, being neutral or having the total base number of 100 mg KOH/g or less and a straight chain univalent fatty acid having 8 to 18 carbon atoms with abase oil of mineral oil series and/or synthetic oil series, said base oil having a kinematic viscosity of 10 to 500 $mm^2/s$ at 40° C.

In accordance with the present invention, furthermore, preferable embodiments include:

(2) a lubricant oil composition according to (1), wherein the kinematic viscosity of the base oil at 40° C. is 30 to 70 $mm^2/s$;

(3) a lubricant oil composition according to (1) and (2), wherein the viscosity index of the base oil is 50 to 150;

(4) a lubricant oil composition according to (1) to (3), wherein the content of aromatic components in the base oil is 20 wt % or less;

(5) a lubricant oil composition according to (1) to (4), wherein the pour point of the base oil is −10° C. or less;

(6) a lubricant oil composition according to (1) to (5), wherein the total base number of the calcium sulfonate, barium sulfonate, or mixture thereof is 50 mg KOH/g or less;

(7) a lubricant oil composition according to (1) to (6), wherein the calcium sulfonate and barium sulfonate are blended at an mount of 0.01 to 5.0 parts by weight to 100 parts by weight of the base oil;

(8) a lubricant oil composition according to (1) to (7), wherein the straight chain univalent fatty acid is blended at an amount of 0.01 to 5.0 parts by weight to 100 parts by weight of the base oil; and (9) a lubricant oil composition according to (1) to (8), wherein the straight chain univalent fatty acid is myristic acid, palmitic acid or oleic acid.

The kinematic viscosity of the base oil to be used in the lubricant oil composition of the present invention may be 10 to 500 $mm^2/s$, preferably 30 to 70 $mm^2/s$ at 40° C. If the kinematic viscosity is less than 10 $mm^2/s$ at 40° C., stickslip may occur on a sliding surface during low-speed operation. If the kinematic viscosity exceeds 500 $mm^2/s$ at 40° C., the floating of the table may be problematic.

The viscosity index of the base oil to be used in the lubricant oil composition in accordance with the present invention may be preferably 50 to 150, more preferably 100 to 120. If the viscosity index is less than 50, the viscosity change of the lubricant oil composition by temperature is so large that a change in the frictional properties may possibly be brought about. The viscosity stability above the viscosity index of 150 is not required under the lubricating conditions at a temperature from room temperature to 50° C. for use. The kinematic viscosity and viscosity index of the base oil can be determined according to JIS K 2283.

Preferably, the base oil to be used in the lubricant oil composition of the present invention has an aromatic component content of 20 wt % or less and a pour point of −10° C. or less. If the content of aromatic components exceeds 20 wt %, the lubricant oil composition may potentially swell sealing rubber. If the pour point exceeds −10° C., the pouring properties may get poor at lower temperatures.

The base oil to be used in the lubricant oil composition of the present invention may be selected appropriately from known mineral oils and synthetic oils, if such oils may satisfy the above requirements. Such mineral oils include a raffinate produced by solvent purifying a lubricant raw material by using an aromatic extraction solvent such as phenol, furfural, n-methyl pyrrolidone; a hydrogenated oil produced by hydrogenation by means of hydrogenating catalysts such as cobalt and molybdenum on a carrier silica-alumina; or a mineral oil such as a lubricant distillate produced by isomerization of wax, including 60 Neutral Oil, 100 Neutral Oil, 150 Neutral Oil, 300 Neutral Oil, 500 Neutral Oil, bright stock and the like. Alternatively, synthetic oils include for example poly (α-olefin oligomer), lucant, polybutene, alkylbenzene, polyol ester, poly gylcol ester, dibasic acid ester, phosphate ester, silicone oil and the like. These base oils may be used singly or in combination with two or more thereof. Also, such mineral oils and such synthetic oils may be mixed together for use.

To the lubricant oil composition of the present invention is blended calcium sulfonate(s), barium sulfonate(s) or mixture thereof, being neutral or having the total base number of 100 mg KOH/g or less, preferably 50 mg KOH/g. The calcium sulfonate and barium sulfonate include a calcium salt and barium salt of for example petroleum sulfonic acid of a molecular weight of 400 to 1200, or synthetic sulfonic acid such as alkylbenzene sulfonic acid, alkyl-naphthalene sulfonic acid and the like. Petroleum sulfonic acid is produced by purifying a petroleum distillate and sulfonating the distillate with fuming sulfuric acid, which may be neutralized into a desirable salt. Alkylbenzene sulfonic acid and alkylnaphthalene sulfonic acid may be produced by alkylating benzene and naphthalene, respectively, and sulfonating the resulting products with fuming sulfuric acid, which may be then neutralized into desirable salts. The calcium sulfonate(s) and barium sulfonate(s) may be used singly or used in combination with two or more thereof. If the total base number of a calcium sulfonate or barium sulfonate exceeds 100 mg KOH/g, the properties of the lubricant oil composition separating from a water-soluble cutting fluid may be deteriorated.

In the lubricant oil composition of the present invention, calcium sulfonate(s), barium sulfonate(s), or mixture thereof is blended preferably at a ratio of 0.01 to 5.0 parts by weight, more preferably 0.1 to 2.0 parts by weight to 100 parts by weight of the base oil. If the calcium sulfonate(s), barium sulfonate(s) or mixture thereof is (are) blended at an mount of less than 0.01 parts by weight to 100 parts by weight of the base oil, the properties of the lubricant oil composition separating from a water-soluble cutting fluid may possibly be deteriorated. If the calcium sulfonate(s), barium sulfonate (s) or mixture thereof is blended at an amount of more than 5.0 parts by weight to 100 parts by weight of the base oil, the properties of the lubricant oil composition separating from a water-soluble cutting fluid may not be improved in proportion to the increase of the amount of the calcium sulfonate or barium sulfonate to be blended.

To the lubricant oil composition of the present invention is blended straight chain univalent fatty acid(s) having 8 to 18 carbon atoms. Such straight chain fatty acid(s) includes, for example, caprylic acid, capric acid, lauric acid, myristic acid, palmitic acid, stearic acid, palmitoleic acid, oleic acid and the like. Even if the number of the carbon atoms of the straight chain fatty acid is either less than 8 or more than 18, the compatibility of the base oil with the straight chain fatty acid may be deteriorated potentially. Among them, myristic acid and palmitic acid are preferable.

In the lubricant oil composition of the present invention is blended preferably 0.01 to 5.0 parts, more preferably 0.1 to 2.0 parts by weight of straight chain univalent fatty acid(s) having 8 to 18 carbon atoms to 100 parts by weight of the base oil. If straight chain univalent fatty acid(s) having 8 to 18 carbon atoms is blended at an amount of less than 0.01 parts by weight to 100 parts of the base oil, the properties of the lubricant oil composition separating from the water-soluble cutting fluid may possibly be deteriorated. Even if a straight chain univalent fatty acid having 8 to 18 carbon atoms is blended at an amount of more than 5.0 parts by weight to 100 parts by weight of the base oil, the properties of the lubricant oil composition separating from the water-soluble cutting fluid is not improved in proportion to the increase of the linear fatty acid to be blended.

Within the limits not detrimental to the objective of the present invention, a wide variety of additives conventionally used in lubricant oils, such as antioxidants, wear preventive agents, friction adjusters, metal deactivators, extreme pressure agents, rust preventives, adhesion improving agents and the like, may be added to the lubricant oil composition of the present invention.

For such antioxidants, use may be made of, for example, phenol series antioxidants, sulfur-containing antioxidants, nitrogen-containing antioxidants and the like, singly or in combination therewith. As such phenol series antioxidants, use may be made of 2,6-di-t-butyl-p-cresol, 2,6-di-t-butylphenol, 4,4'-methylene bis(2,6-di-t-butylphenol) and the like; as such sulfur-containing antioxidants, use may be made of diphenyl monosulfide, diphenyl disulfide and the like; and as such nitrogen-containing antioxidants, use may be made of alkylated diphenylamine, phenyl-α-naphthylamine, alkylated α-naphthylamine, and the like. Such wear preventive agents include for example dibenzyl disulfide, polysulfide, sulfurized fat and oil, sulfide ester, phosphate ester, phosphite ester, thiophosphate ester, zinc thiophosphate, zinc thiocarbamate and the like. Such friction adjusters include for example polyhydric alcohol partial ester, amine, amide, sulfide ester, sulfurized fat and oil, phosphate ester, phosphate ester amine salt, phosphite ester and organic molybdenum compounds and the like. Such metal deactivators include for example 2,5-dimercapto-1,3,4-thiadiazole and benzotriazole series and the like. Such extreme pressure agents include for example olefin sulfide. Such rust preventives include for example dinonyl naphthalene calcium sulfonate basic salt, dinonyl naphthalene barium sulfonate basic salt and the like. Such viscosity index improving agents include for example polymethacrylate series, polyisobutylene series, ethylene-propylene copolymer series, styrene-butadiene hydrogenation copolymer series and the like. The aforementioned additives may be blended at a ratio of 0.01 to 5.0 parts by weight to 100 parts by weight of the base oil.

The lubricant oil composition of the present invention exerts the extremely great separation properties when used in combination with a cutting fluid prepared by diluting a water-soluble cutting fluid with water. The water-soluble cutting fluid defined by JIS K2241 includes an emulsion type, soluble type and chemical solution type. The lubricant oil composition of the present invention has excellent separation properties for any of the types.

EXAMPLES

The present invention will now be apparent from the following more particular description of the examples, but it will be understood that the examples do not purport to be wholly definitive with respect to the scope of the invention.

A test was carded out according to JIS K 2520 on petroleum products-lubricant oil-demulsibility tests, except that a cutting fluid was employed instead of water. As the cutting fluid, use was made of a commercially available emulsion-type water-soluble cutting fluid (manufactured by Yushio Chemical Co., Ltd.) thirtyfold diluted with ion exchanged water. The cutting fluid and a simple lubricant oil were weighed and picked up into a test tube such that the cutting fluid and sample lubricant oil were 40 ml in volume, respectively, at the test temperature. The test tube was placed and held in a constant temperature bath kept at the test temperature. After the content reached the test temperature, a stirring plate was placed in the center of the test tube to stir up at the rate of 1500±15 revolutions per minute for just 5 minutes. After the completion of stirring, the inside of the test tube was observed from the side face to record the volumes of the oil layer, the cutting fluid layer, and the emulsified layer every 10 minutes over 60 minutes. All the kinematic viscosities of the sample lubricant oils prepared in the present Examples and Comparative Examples were within 28.8 to 90 $mm^2/s$ at 40° C. The test temperature was set at 54±1° C.

Example 1

A sample lubricant oil was prepared by blending 0.2 parts by weight of di-t-butyl-p-cresol as an antioxidant, 0.5 parts by weight of dibenzyl disulfide as a wear preventive agent, 2 parts by weight of the salt of di-iso-octyl phosphate and monotetradecylamine as a friction adjuster, 0.5 parts by weight of calcium sulfonate (neutral salt) and 0.3 parts by weight of palmitic acid, to 100 parts by weight of a mineral oil series base oil having a kinematic viscosity of 68.0 $mm^2/s$ at 40° C.

Because the kinematic viscosity of the sample lubricant oil at 40° C. was 67.5 $mm^2/s$, a demulsibility test was carried out at 54° C. For ten minutes after the initiation of the test, the volumes of the oil layer/the cutting fluid layer/the emulsified layer were 24/20/36 ml, respectively, but the lubricant oil rapidly separated and floated with the passage of time. Sixty minutes later, the volumes of the oil layer/the cutting fluid layer/the emulsified layer were 40/36/4 ml, respectively. The results of observation are shown in Table 1, including the intermediate course.

Examples 2 to 5 and Comparative Examples 1 to 3

According to the blending in Table 1, sample lubricant oil compositions were prepared to carry out the demulsibility test. The results are shown in Table 1.

As to the separation properties of cutting fluids, rapid increase of the volumes of an oil layer and a cutting fluid layer was rated as excellent; it was determined that a cutting fluid capable of separating by 30 ml or more each of an oil layer and a cutting fluid for a period of 60 minutes should have excellent properties from the practical viewpoint.

All of a lubricant oil of Example 1 blended with calcium sulfonate (neutral salt) and palmitic acid, a lubricant oil of Example 2 blended with a calcium sulfonate (neutral salt) and myristic acid, a lubricant oil of Example 3 blended with a barium sulfonate (neutral salt) and palmitic acid, and a lubricant oil of Example 4 blended with a calcium sulfonate (total base number; 50 mg KOH/g) and palmitic add, exert excellent separation properties. As to the separation properties of a lubricant oil of Example 5 blended with a barium sulfonate (neutral salt) and oleic acid, each of an oil layer and a cutting fluid layer is separated by 30 ml or more in the course of 60 minutes, so that the lubricant oil is regarded as practically having excellent separation properties though the properties are inferior to those of the lubricant oils of Examples 1 to 4.

On the contrary, the lubricant oil of Comparative Example 1 blended with palmitic acid and no sulfonate does not separate an oil layer in the course of 60 minutes. As to the lubricant oil of Comparative Example 2 blended with a calcium sulfonate (neutral salt) and no straight chain fatty acid, both of an oil layer and a cutting fluid do fall short of 30 ml in volume even in the course of 60 minutes. Based on these results, it will be apparent that the combined use of a calcium sulfonate or barium sulfonate with a straight chain fatty acid is essential for improving the separation properties of a lubricant oil. When they are used singly, no such advantages of the present invention can be brought about. It will be also apparent that as to the lubricant oil of Comparative Example 3 blended with a calcium sulfonate having the total base number of 300 mg KOH/g and palmitic acid, both an oil layer and a cutting fluid do fall short of 30 ml in volume in the course of 60 minutes and whereby no excellent separation properties can be exerted by a calcium sulfonate having a larger total base number even if used in combination with a straight chain fatty acid.

The lubricant oil composition of the present invention exerts excellent separation properties from a cutting fluid prepared by diluting a water-soluble cutting fluid. Therefore, the composition so readily separates and floats in a reservoir tank for the cutting fluid that the composition can be removed simply by means of an oil skimmer and the like. Thus, the properties of the water-soluble cutting fluid can be maintained for a long term, with no occurrence of poor work environment due to rot and so on.

TABLE 1

| | | Examples | | | | | Comparative Examples | | |
|---|---|---|---|---|---|---|---|---|---|
| | | 1 | 2 | 3 | 4 | 5 | 1 | 2 | 3 |
| Mineral base oil (VG68) | (parts by weight) | 100 | 100 | 100 | 100 | 100 | 100 | 100 | 100 |
| Antioxidant | (parts by weight) | 0.2 | 0.2 | 0.2 | 0.2 | 0.2 | 0.2 | 0.2 | 0.2 |
| Anti-abrasion agent | (parts by weight) | 0.5 | 0.5 | 0.5 | 0.5 | 0.5 | 0.5 | 0.5 | 0.5 |
| Wear adjuster | (parts by weight) | 2 | 2 | 2 | 2 | 2 | 2 | 2 | 2 |
| Sulfonate (parts by weight) | Calcium sulfonate (neutral salt) | 0.5 | 0.5 | — | — | — | — | 0.5 | — |
| | Barium sulfonate (neutral salt) | — | — | 0.5 | — | 0.5 | — | — | — |
| | Calcium sulfonate (50 TBN) | — | — | — | 0.5 | — | — | — | — |
| | Calcium sulfonate | — | — | — | — | — | — | — | 0.5 |

TABLE 1-continued

| | | Examples | | | | | Comparative Examples | | |
|---|---|---|---|---|---|---|---|---|---|
| | | 1 | 2 | 3 | 4 | 5 | 1 | 2 | 3 |
| | (300 TBN) | | | | | | | | |
| Linear fatty acid | Palmitic acid | 0.3 | — | 0.3 | 0.3 | — | 0.3 | — | 0.3 |
| (parts by weight) | Myristic acid | — | 0.3 | — | — | — | — | — | — |
| | Oleic acid | — | — | — | — | 0.3 | — | — | — |
| Oil layer/cutting solution | 10 minutes | 24/20/36 | 26/30/24 | 26/31/23 | 24/22/34 | 6/20/54 | 0/28/52 | 3/18/59 | 4/15/61 |
| layer/emulsified layer (ml) | 20 minutes | 34/25/21 | 38/30/12 | 35/32/13 | 35/32/13 | 15/27/38 | 0/31/49 | 6/18/56 | 5/18/57 |
| | 30 minutes | 37/25/18 | 39/35/6 | 37/33/10 | 37/31/12 | 18/31/31 | 0/32/48 | 11/22/47 | 8/19/53 |
| | 40 minutes | 39/30/11 | 40/36/4 | 39/35/6 | 38/33/9 | 23/32/25 | 0/33/47 | 15/24/41 | 10/21/49 |
| | 50 minutes | 40/34/6 | 40/38/2 | 40/37/3 | 39/35/6 | 27/32/21 | 0/33/47 | 17/27/36 | 10/22/48 |
| | 60 minutes | 40/36/4 | 40/38/2 | 40/39/1 | 39/36/5 | 32/33/15 | 0/34/46 | 19/29/32 | 10/22/48 |

What is claimed is:

1. A lubricant oil composition for use as a slide way oil which easily separates from water soluble cutting fluids, said composition comprising a base oil of mineral oil series and/or synthetic oil series, said base oil having a kinematic viscosity of 10 to 500 $mm^2/s$ at 40° C. and 0.001 to 5.0 parts by weight per 100 parts by weight of the base oil of calcium sulfonate(s), barium sulfonate(s) or mixtures thereof being neutral or having the total base number of 100 mg KOH/g or less, and 0.01 to 5.0 parts by weight per 100 parts by weight of the base oil of straight chain univalent saturated fatty acid(s) having 8 to 14 carbon atoms.

2. The lubricant oil of claim 1, wherein the kinematic viscosity of the base oil at 40° C. is 30 to 70 $mm^2/s$.

3. The lubricant oil of claim 1, wherein the viscosity index of the base oil is 50 to 150.

4. The lubricant oil of claim 1, wherein the aromatic content of the base oil is 20 wt % or less.

5. The lubricant oil of claim 1, wherein the total base number of the calcium sulfonate(s), barium sulfonate(s) or mixture thereof is 50 mg KOH/g or less.

6. A method for improving the separability of a slide way oil, comprising a base oil of mineral oil series and/or synthetic oil series, said base oil having a kinematic viscosity of 10 to 500 $mm^2/s$ at 40° C., from water soluble cutting fluids by adding to the slide way base oil from 0.01 to 5.0 parts by weight per 100 parts by weight of the base oil of calcium sulfonate(s), barium sulfonate(s) or mixtures thereof being neutral or having the total base number of 100 mg KOH/g or less, and 0.01 to 5.0 parts by weight per 100 parts by weight of the base oil of straight chain univalent saturated fatty acid(s) having 8 to 14 carbon atoms.

7. The method of claim 6 wherein the aromatic content of the base oil is 20 wt % or less.

8. The method of claim 6 wherein the total base number of the calcium sulfonate(s), barium sulfonate(s) or mixture thereof is 50 mg KOH/g or less.

* * * * *